US009752593B2

(12) United States Patent
Bagnall

(10) Patent No.: US 9,752,593 B2
(45) Date of Patent: Sep. 5, 2017

(54) METHOD OF MANUFACTURING A GAS TURBINE ENGINE HAVING A FAN TRACK LINER WITH AN ABRADABLE LAYER

(71) Applicant: ROLLS-ROYCE PLC, London (GB)

(72) Inventor: Adam M Bagnall, Derby (GB)

(73) Assignee: ROLLS-ROYCE plc, London (GB)

( * ) Notice: Subject to any disclaimer, the term of this patent is extended or adjusted under 35 U.S.C. 154(b) by 170 days.

(21) Appl. No.: 14/642,149

(22) Filed: Mar. 9, 2015

(65) Prior Publication Data

US 2016/0177971 A1 Jun. 23, 2016

(30) Foreign Application Priority Data

Mar. 31, 2014 (GB) ..... 1405704.6

(51) Int. Cl.

| | |
|---|---|
| ***F04D 29/52*** | (2006.01) |
| ***F04D 29/08*** | (2006.01) |
| ***F04D 29/32*** | (2006.01) |
| ***F04D 29/38*** | (2006.01) |
| ***B24B 19/14*** | (2006.01) |
| ***F01D 11/12*** | (2006.01) |
| ***F01D 21/04*** | (2006.01) |

(52) U.S. Cl.

CPC ..... *F04D 29/526* (2013.01); *B24B 19/14* (2013.01); *F01D 11/122* (2013.01); *F04D 29/083* (2013.01); *F04D 29/325* (2013.01); *F04D 29/38* (2013.01); *F01D 21/045* (2013.01); *F05D 2220/36* (2013.01)

(58) Field of Classification Search

CPC ..... F04D 29/526; F04D 29/38; F04D 29/325; F04D 29/083; B24B 19/14; F01D 11/122; F01D 11/125; F01D 11/127; F01D 21/045

See application file for complete search history.

(56) References Cited

U.S. PATENT DOCUMENTS 3,879,831 A * 4/1975 Rigney ..... C22C 32/00 277/415
4,566,700 A 1/1986 Shiembob
5,304,032 A * 4/1994 Bosna ..... C23C 4/18 415/173.4

(Continued)

FOREIGN PATENT DOCUMENTS

DE 10 2011 081 323 B3 6/2012
EP 1312760 A2 5/2003

(Continued)

OTHER PUBLICATIONS

Nov. 4, 2014 Search Report issued in British Application No. GB1405704.6.

(Continued)

*Primary Examiner* — Nathaniel Wiehe
*Assistant Examiner* — Elton Wong
(74) *Attorney, Agent, or Firm* — Oliff PLC

(57) ABSTRACT

A fan casing for fitment around an array of radially extending fan blades of a gas turbine engine. The fan casing includes an annular casing element; and an annular fan track liner positioned radially inward of the annular casing element. The fan track liner includes an abradable layer and an abrasive layer, the abrasive layer being positioned radially inward of the abradable layer and proximal, in use, to the fan blades.

11 Claims, 9 Drawing Sheets

(56) References Cited

U.S. PATENT DOCUMENTS

| | | | | |
|---|---|---|---|---|
| 7,178,808 | B2 * | 2/2007 | Grunke | C23C 28/3215 277/409 |
| 7,241,108 | B2 | 7/2007 | Lewis | |
| 2012/0099968 | A1 * | 4/2012 | Zajchowski | C23C 4/02 415/170.1 |
| 2012/0099992 | A1 | 4/2012 | Strock et al. | |
| 2012/0121431 | A1 * | 5/2012 | Jakimov | C23C 24/04 416/241 R |
| 2012/0227333 | A1 * | 9/2012 | Adefris | B24D 3/00 51/309 |

FOREIGN PATENT DOCUMENTS

| | | | |
|---|---|---|---|
| EP | 1 555 392 | A2 | 7/2005 |
| GB | 2125119 | A | 2/1984 |
| GB | 2346656 | A | 8/2000 |
| GB | 2399777 | A | 9/2004 |
| GB | 2475850 | A | 6/2011 |
| GB | 2496887 | A | 5/2013 |

OTHER PUBLICATIONS

Aug. 12, 2015 Search Report issued in European Patent Application No. 15 15 8014.

* cited by examiner

METHOD OF MANUFACTURING A GAS TURBINE ENGINE HAVING A FAN TRACK LINER WITH AN ABRADABLE LAYER

FIELD OF INVENTION

The invention relates to a stationary member, in particular but not exclusively a fan casing, and/or a machine, in particular but not exclusively a gas turbine engine.

BACKGROUND

Turbofan gas turbine engines (which may be referred to simply as 'turbofans') are typically employed to power aircraft. Turbofans are particularly useful on commercial aircraft where fuel consumption is a primary concern. Typically a turbofan gas turbine engine will comprise an axial fan driven by an engine core. The engine core is generally made up of one or more turbines which drive respective compressors via coaxial shafts. The fan is usually driven directly off an additional lower pressure turbine in the engine core.

The fan comprises an array of radially extending fan blades mounted on a rotor and will usually provide, in current high bypass gas turbine engines, around seventy-five percent of the overall thrust generated by the gas turbine engine. The remaining portion of air from the fan is ingested by the engine core and is further compressed, combusted, accelerated and exhausted through a nozzle. The engine core exhaust mixes with the remaining portion of relatively high-volume, low-velocity air bypassing the engine core through a bypass duct.

The fan is surrounded by a fan casing. Generally the fan casing includes a fan track liner positioned so as to surround the fan blades and be proximal thereto. The arrangement of the fan track liner will depend on the engine type and the type of blades used, e.g. metallic or composite blades. The following is an example of the types of fan track liners for metallic fan blades.

A conventional fan containment system or arrangement 100 is illustrated in FIG. 1 and surrounds a fan comprising an array of radially extending fan blades 40. Each fan blade 40 has a leading edge 44, a trailing edge 45 and fan blade tip 42. The fan containment arrangement 100 comprises a fan case 150. The fan case 150 has a generally frustoconical or cylindrical annular casing element 152 and a hook 154. The hook 154 is positioned axially forward of an array of radially extending fan blades 40. A fan track liner 156 is mechanically fixed or directly bonded to the annular casing element 152. The fan track liner 156 is provided as a structural intermediate to bridge a deliberate gap provided between the annular casing element 152 and the fan blade tip 42.

The fan track liner 156 has, in circumferential layers, an attrition liner 158 (also referred to as an abradable liner or an abradable layer), an intermediate layer which in this example is a honeycomb layer 160, and a septum 162. The septum layer 162 acts as a bonding, separation, and load spreading layer between the attrition liner 158 and the honeycomb layer 160. The honeycomb layer 160 may be an aluminium honeycomb. The tips 42 of the fan blades 40 are intended to pass as close as possible to the attrition liner 158 when rotating. The attrition liner 158 is therefore designed to be abraded away by the fan blade tips 42 during abnormal operational movements of the fan blade 40 and to just touch during the extreme of normal operation to ensure the gap between the rotating fan blade tips 42 and the fan track liner 156 is as small as possible without wearing a trench in the attrition liner 158. During normal operations of the gas turbine engine, ordinary and expected movements of the fan blade 40 rotational envelope cause abrasion of the attrition liner 158. This allows the best possible seal between the fan blades 40 and the fan track liner 156 and so improves the effectiveness of the fan in driving air through the engine.

The purpose of the hook 154 is to ensure that, in the event that a fan blade 40 detaches from the rotor of the fan 12, the fan blade 40 will not be ejected through the front, or intake, of the gas turbine engine. During such a fan-blade-off event, the fan blade 40 is held by the hook 154, and a trailing blade (not shown) then forces the held released blade rearwards where the released blade is contained. Thus the fan blade 40 is unable to cause damage to structures outside of the gas turbine engine casings.

As can be seen from FIG. 1, for the hook 154 to function effectively, a released fan blade 40 must penetrate the attrition liner 158 in order for its forward trajectory to intercept with the hook. If the attrition liner 158 is too hard then the released fan blade 40 may not sufficiently crush the fan track liner 156.

However, the fan track liner 156 must also be stiff enough to withstand the rigours of normal operation without sustaining damage. This means the fan track liner 156 must be strong enough to withstand ice and other foreign object impacts without exhibiting damage for example. Thus there is a design conflict, where on one hand the fan track liner 156 must be hard enough to remain undamaged during normal operation, for example when subjected to ice impacts, and on the other hand allow the tip 42 of the fan blade 40 to penetrate the attrition liner 158. It is a problem of balance in making the fan track liner 156 sufficiently hard enough to sustain foreign object impact, whilst at the same time, not be so hard as to alter the preferred hook-interception trajectory of a fan blade 40 released from the rotor. Ice that impacts the fan casing rearwards of the blade position is resisted by a reinforced rearward portion 164 of the fan track liner.

An alternative fan containment system is indicated generally at 200 in FIG. 2. The fan containment system 200 includes a fan track liner 256 that is connected to the annular casing element 252 at both an axially forward position and an axially rearward position. At the axially forward position, the fan track liner is connected to the annular casing element via hook 254 and a fastener 266, the fastener 266 being configured to fail at a predetermined load. In the event of a fan blade detaching from the remainder of the fan, the fan blade impacts the fan track liner 256, the fastener 266 fails and the fan track liner pivots about a rearward point on the fan track liner. Such an arrangement is often referred to as a trap door arrangement. The trap door arrangement has been found to help balance the requirements for stiffness of the fan track liner with the requirements for resistance of operational impacts (e.g. ice impacts) ensuring a detached blade is held within the engine.

When the fan comprises composite blades, a similar fan containment system as those previously described may be used, but alternatively no hook may be provided. This is because the fan track liner can be configured so that the fan blades break up on impact with the fan track liner.

The attrition layer of the described fan track liner panels allows the longest blade of the fan to rub into the fan track liner without significant damage to the fan blades. Typically, the longest fan blade will rub and abrade away the liner by differing amounts over the full 360 degrees circumference, when the engine is operating at its highest power setting. This process advantageously trues the casing and removes any casing asymmetries so as to permit the longest fan blade to run at zero clearance around the circumference of the casing when the engine is running at its highest power setting.

It is known for other rotating blades (e.g. turbine blades) of a gas turbine engine to provide an abrasive layer on a radially adjacent static component (e.g. a turbine casing), this abrasive layer corrects for the differences in length of the blades. However, this arrangement does not account for any asymmetries, such as those discussed to be present on a fan case. This results in the fan case removing a larger portion than necessary from the blades so that the fan runs at a larger clearance. Further, in the case of fan blades, there is likely to be localised deflection of the fan case relative to the fan blades that will cause damage to the fan blades and further increase the clearance between the fan blades and the fan track liner. Accordingly, the use of an abrasive coating can also result in reduced efficiency of a gas turbine engine.

SUMMARY OF INVENTION

The present disclosure seeks amongst other things to provide a fan assembly with minimal clearance between a fan track liner and fan blades so as to improve efficiency of a gas turbine engine.

A first aspect of the invention provides a fan casing for fitment around an array of radially extending fan blades of a gas turbine engine, the fan casing comprising: an annular casing element; and an annular fan track liner positioned radially inward of the annular casing element, wherein the fan track liner comprises an abradable layer and an abrasive layer, the abrasive layer being positioned radially inward of the abradable layer and proximal, in use, to the fan blades.

The abradable layer is provided so that during operational use the fan blades can abrade the abradable layer if the fan casing experiences aero loads (e.g. turbulence) that cause the fan casing to flex so as to be out-of-round. The abrasive layer is provided so that during initial running of the engine, before operational service, the abrasive layer can abrade the tips of one or more of the blades. In this way, the length of the fan blades can be modified so that each fan blade has a similar length.

The provision of the abrasive layer means that when the engine is run for the first time (e.g. during engine pass-off at the end of the manufacturing process), the fan blades are trued, which results in a clearance gap between the fan track liner and the fan blades being as small as possible.

The following are optional features of the first aspect. Optional features may be used alone or in combination.

The abradable layer may be an annular abradable layer, e.g. extending the full circumferential extent of the fan track liner. The abrasive layer may be an annular abrasive layer, e.g. extending the full circumferential extent of the fan track liner.

The abrasive layer may be a sacrificial abrasive layer. For example, the thickness of the abrasive layer may be selected such that the abrasive layer is substantially removed from the fan track liner during a standard engine pass-off procedure. The person skilled in the art is familiar with the conditions for a standard engine pass-off procedure and so these will not be described further here. After the engine pass-off procedure only a small amount or no abrasive layer may remain on the fan track liner.

The abradable layer means that the casing can account for in service deformation (e.g. flexing) of the casing, without unnecessarily shortening the blades. Providing a sacrificial layer means that the blades can be trued during first running of the engine. The process of truing the blades substantially removes some or all of the abrasive layer from the fan track liner thus exposing the abradable liner. The fan blades are then free to abrade the abradable liner during service without affecting the overall length of the blades.

The abrasive layer may be arranged so as to be substantially removed after engine pass-off. Additionally or alternatively, the abrasive layer may be arranged so as to be substantially removed after running the engine at maximum speed for a predetermined number of rotation. There may be a small amount of the abrasive layer remaining due to manufacturing tolerances resulting in the fan casing being "out-of-round".

"Engine pass-off" is a term of art and refers to the initial running of the engine that takes place in a manufacturing environment before an engine is shipped to a customer/put on wing of an engine. The predetermined number of rotations may be calculated using known modelling techniques (e.g. statistical or otherwise).

The composition of the abrasive layer may be selected such that the abrasive layer is removed during engine pass-off and/or to minimise heat generation in blade tips that rub against the abrasive layer.

The abrasive layer may comprise abrasive particles. In exemplary embodiments, the abrasive layer may comprise a resin matrix in which the abrasive particles are suspended. The abrasive particles may be sharp edged rhomboid particles. For example, the abrasive particles may be diamond grit.

A second aspect of the invention provides a fan casing for fitment around an array of radially extending fan blades of a gas turbine engine, the fan casing comprising: an annular casing element; and an annular fan track liner positioned radially inward of the annular casing element; wherein the fan track liner comprises an abradable layer arranged to be abraded by the fan blades during in service operation of the gas turbine engine, and an arrangement configured to interact with the tips of blades about which the fan case is fitted so as to alter the length of one or more blades prior to in service operation of the gas turbine engine.

The arrangement may be configured so as to not substantially interact with the blades during in service operation of the fan casing.

The arrangement may comprise an abrasive layer proximal to the fan blades.

Any one of, or any combination of, the optional features of the first aspect are also optional features of the second aspect.

A third aspect of the invention provides a gas turbine engine comprising a fan casing according to the first or second aspects.

A fourth aspect of the invention provides a gas turbine engine comprising: a fan casing; and an array of fan blades arranged around a hub; wherein the fan casing comprises an annular fan track liner positioned circumferentially around the fan blades, the fan track liner comprising an abradable layer proximal to the fan blades, and wherein the variation in length of the fan blades is equal to or less than ±0.15 mm. For example, equal to or less than ±0.10 mm.

In a pre-manufacturing step, the gas turbine engine may comprise a fan casing of the first or second aspects.

A fifth aspect of the invention provides a stationary member for concentric arrangement around a rotating member, the stationary member comprising: an abradable layer provided in a region corresponding to a rotational path of the rotating member; and a sacrificial abrasive layer provided on a surface of the abradable layer that in use is proximal to the rotating member, wherein the sacrificial abrasive layer is configured to be removed after a predetermined number of rotations of the rotating member at a predetermined speed so as to true the rotating member.

A sixth aspect of the invention provides a machine comprising: a rotating member and a stationary member arranged substantially concentric to each other; an abradable layer and a sacrificial abrasive layer are provided radially between the rotating member and the stationary member, wherein the sacrificial abrasive layer is configured to be removed after a predetermined number of rotations of the rotating member at a predetermined speed so as to true the rotating or stationary member.

Reference to the rotating member and the stationary member being arranged substantially concentric to each other refers to the ideal arrangement, but due to manufacturing tolerances and or operational loadings, the rotating and stationary member may be not be precisely concentric.

The machine may be a gas turbine engine. The rotating member may be a fan blade, compressor blade, a compressor drum, a turbine blade, or an arm or flange of turbine disc. The stationary member may be a fan case, a compressor casing, a stator of a compressor, a turbine casing and/or a stator of a turbine. For example, the abradable layer may form part of or define a seal between the rotating and stationary members.

The abradable and sacrificial layer may be provided on the stationary member, for example if the stationary member is a fan casing, a compressor casing or a turbine casing. Alternatively, the abradable and sacrificial layer may be provided on the rotating member, for example if the rotating member is a compressor drum or an arm or flange of a turbine disc.

The optional features (and any combination thereof) of the first and second aspects are also optional features of the fifth aspect. It will be appreciated by the person skilled in the art that where features are described with reference to the fan casing these features are also relevant to the compressor casing, compressor stators, turbine casing and turbine stators. It will also be appreciated by the person skilled I the art that where features are described with reference to the blades these features are also relevant to the compressor blades, compressor drum, turbine blades and the arms or flanges of the turbine disc.

A seventh aspect of the invention provides a method of trueing fan blades of a gas turbine engine, the gas turbine engine comprising an array of fan blades arranged around a hub and a fan case, the fan case comprising an annular fan track liner positioned circumferentially around the fan blades, and having an abradable layer, the method comprising: providing an arrangement for interacting with the fan blades to adjust the length of the fan blades during initial running of the engine; and running the engine for a predetermined time so that the arrangement interacts with one or more of the fan blades and adjusts the length thereof.

The method may comprise providing an abrasive layer on a radially inward surface of the abradable layer and running the engine (e.g. at maximum speed) so as to abrade one or more of the fan blades and shorten the length thereof.

A seventh aspect of the invention provides a method of manufacturing a gas turbine engine comprising: providing a series of fan blades about a hub, arranging an annular fan case having an annular fan track liner circumferentially around the fan blades, wherein the fan track liner comprises an abradable layer and an abrasive layer on a radially inner surface of the abradable layer; and rotating the fan blades such that the abrasive layer removes a section from a tip of one or more of the fan blades.

The following are optional features of the sixth or seventh aspects.

The abrasive layer may be substantially removed during rotation of the fan blades (e.g. at maximum speed).

The length of the one or more fan blades may be reduced before the engine is mounted on-wing of an aircraft.

The gas turbine engine may be a gas turbine engine of the third aspect.

DESCRIPTION OF DRAWINGS

The invention will now be described, by way of example only, with reference to the accompanying drawings in which.

DETAILED DESCRIPTION

Figure 1:
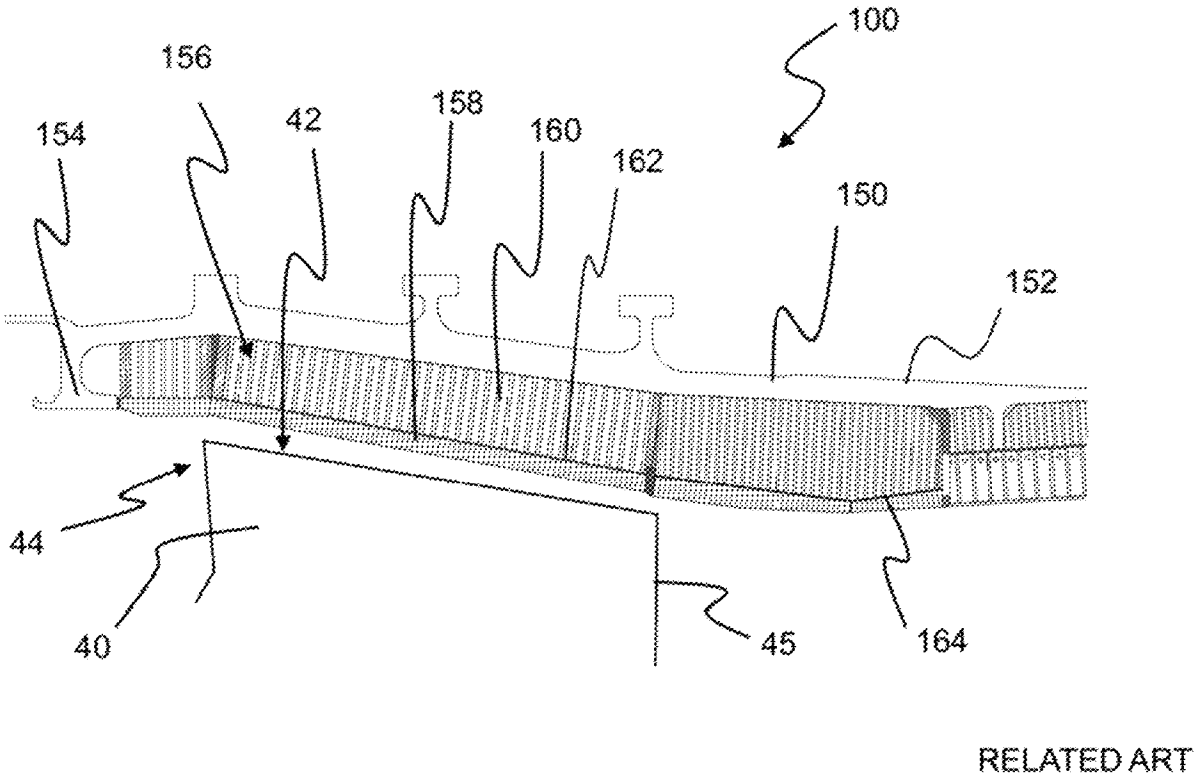
FIG. 1 illustrates a partial view of a cross-section through a typical fan case arrangement of a gas turbine engine of related art.
Figure 2:
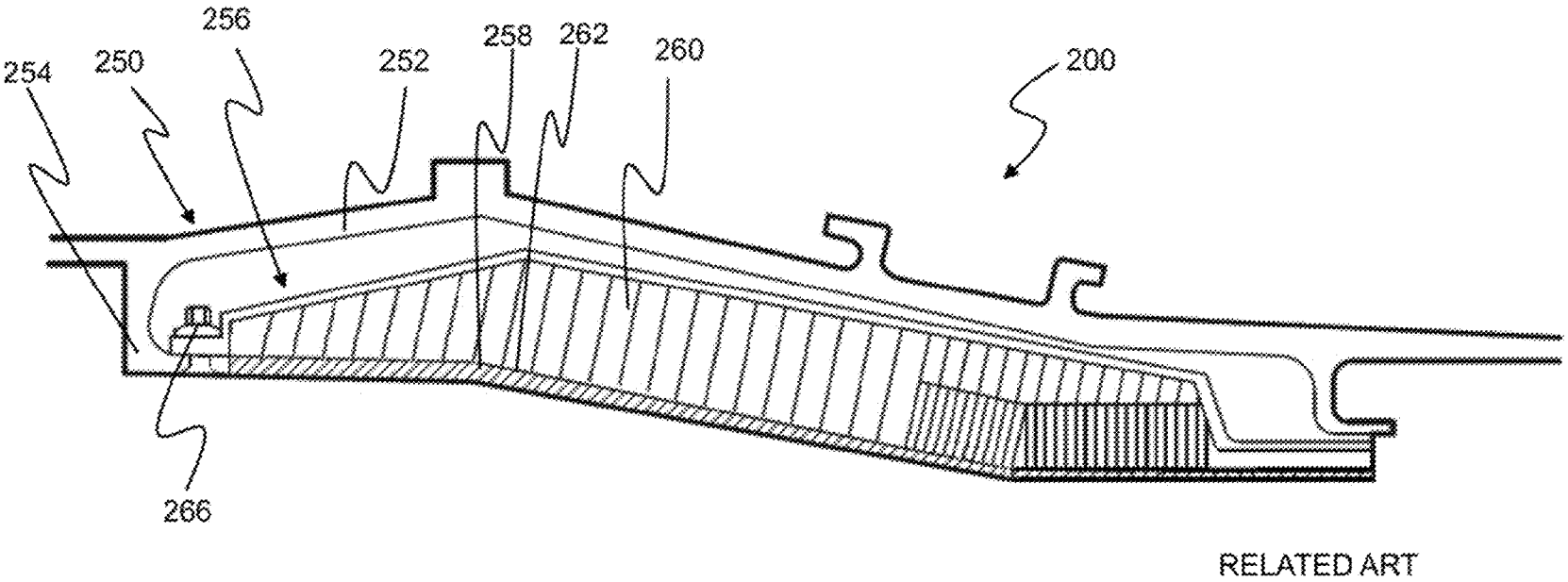
FIG. 2 illustrates a partial view of a cross-section through an alternative fan case arrangement of a gas turbine engine of related art.
Figure 3:
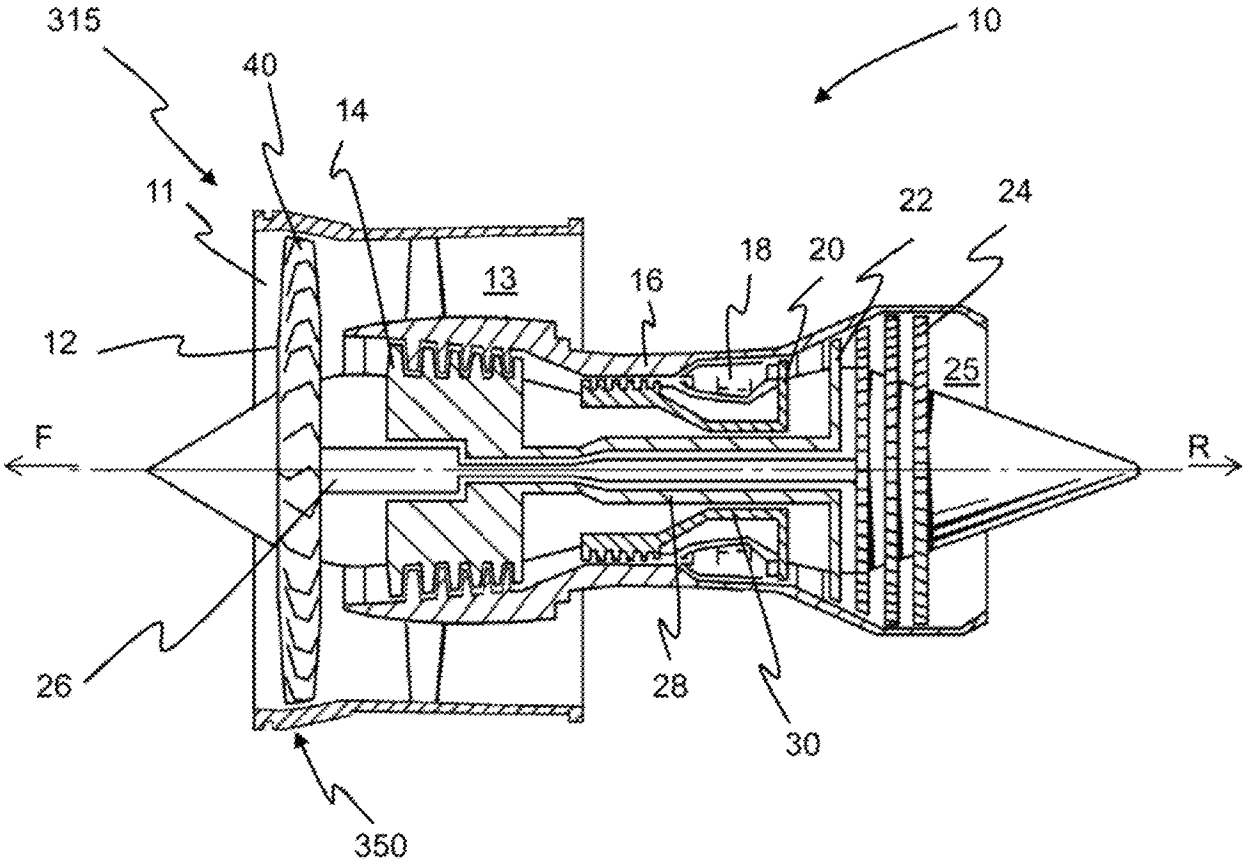
FIG. 3 illustrates a cross-section through the rotational axis of a high-bypass gas turbine engine.

With reference to FIG. 3 a bypass gas turbine engine is indicated at 10. The engine 10 comprises, in axial flow series, an air intake duct 11, fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 18, 20, 22 all rotate about the major axis of the gas turbine engine 10 and so define the axial direction of the gas turbine engine.

Air is drawn through the air intake duct 11 by the fan 12 where it is accelerated. A significant portion of the airflow is discharged through the bypass duct 13 generating a corresponding portion of the engine thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 26, 28, 30. The working fluid, which has reduced in pressure and temperature, is then expelled through the exhaust nozzle 25 generating the remainder of the engine thrust.

The intake fan 12 comprises an array of radially extending fan blades 40 that are mounted to the shaft 26. The shaft 26 may be considered a hub at the position where the fan blades 40 are mounted. FIG. 3 shows that the fan 12 is surrounded by a fan case 350 that also forms one wall or a part of the bypass duct 13. In the present application, the arrangement of the fan and fan casing is referred to as a fan assembly 315.

In the present application a forward direction (indicated by arrow F in FIG. 3) and a rearward direction (indicated by arrow R in FIG. 3) are defined in terms of axial airflow through the engine 10.

Figure 4:
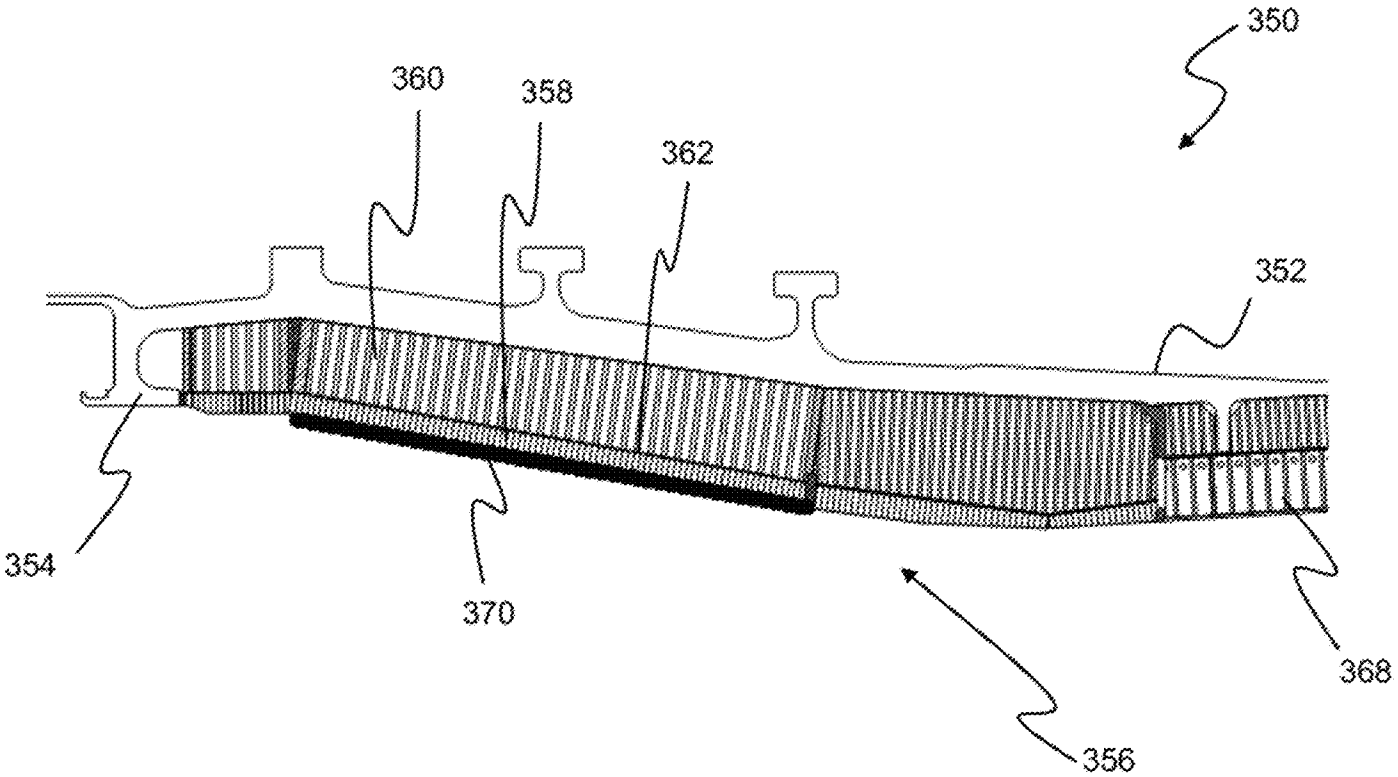
FIG. 4 illustrates a partial cross-section through a fan casing.

Referring now to FIG. 4, a fan case 350 is shown in more detail. The fan case 350 includes an annular casing element 352 that, in use, encircles the fan blades (indicated at 40 in FIG. 3) of the gas turbine engine (indicated at 10 in FIG. 3). The fan case 350 further includes a hook 354 that projects from the annular casing element in a generally radially inward direction. The hook 354 is positioned, in use, axially forward of the fan blades and the hook is arranged so as to extend axially inwardly, such that if a fan blade (or part of a fan blade) is released from the hub the hook 354 prevents the fan blade from exiting the engine through the air intake duct (indicated at 11 in FIG. 3).

In the present embodiment, the hook 354 is substantially L-shaped and has a radial component extending radially inwards from the annular casing element 352 and an axial component extending axially rearward towards the fan blades 40 from the radial component.

A fan track liner 356 is connected to the casing element 352. More specifically, a radially outer surface of the fan track liner is bonded to a radially inner surface of the casing element. The fan track liner extends from a position adjacent the hook 354 to an acoustic panel 368 positioned rearward of the fan track liner.

The fan track liner 356 includes an intermediate layer 360 proximal to the casing element 352. The intermediate layer 360 is formed from an aluminium honeycomb structure, but in alternative embodiments an alternative metallic or non-metallic honeycomb structure may be used or a suitable foam may be used. A septum layer 362 is provided on a radially inner surface of the intermediate layer. The septum layer provides the function of bonding an abradable layer 358 to the intermediate layer and also spreads loading across the fan track liner. In a region of the fan track liner corresponding to a position of the fan blades and on a radially inner side of the fan track liner, a sacrificial abrasive layer 370 is provided.

In the present embodiment the sacrificial abrasive layer comprises a resin matrix in which abrasive particles are suspended. Suitable abrasive particles include sharp edged rhomboid particles such as diamond grit. However, in alternative embodiments the abrasive layer may have any other suitable composition.

The functionality of the sacrificial abrasive layer will now be described in more detail with reference to FIGS. 6A to 6E which are compared to a casing of related art shown in FIGS. 5A to 5E.

Figure 6A:
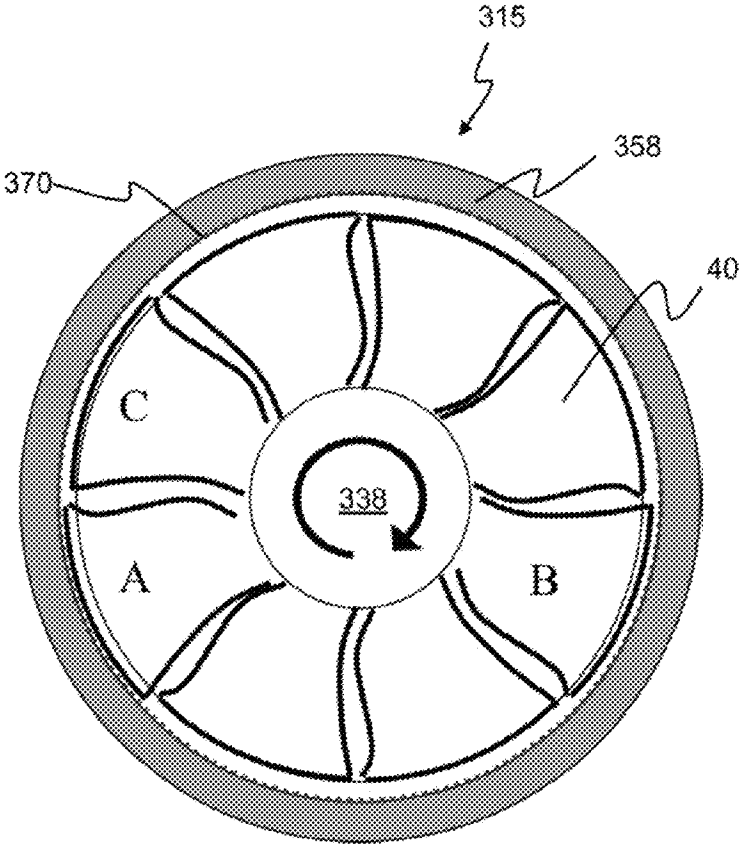
FIGS. 6A to 6E illustrate a fan assembly according to the present disclosure at different stages during engine pass-off.
Figure 5A:
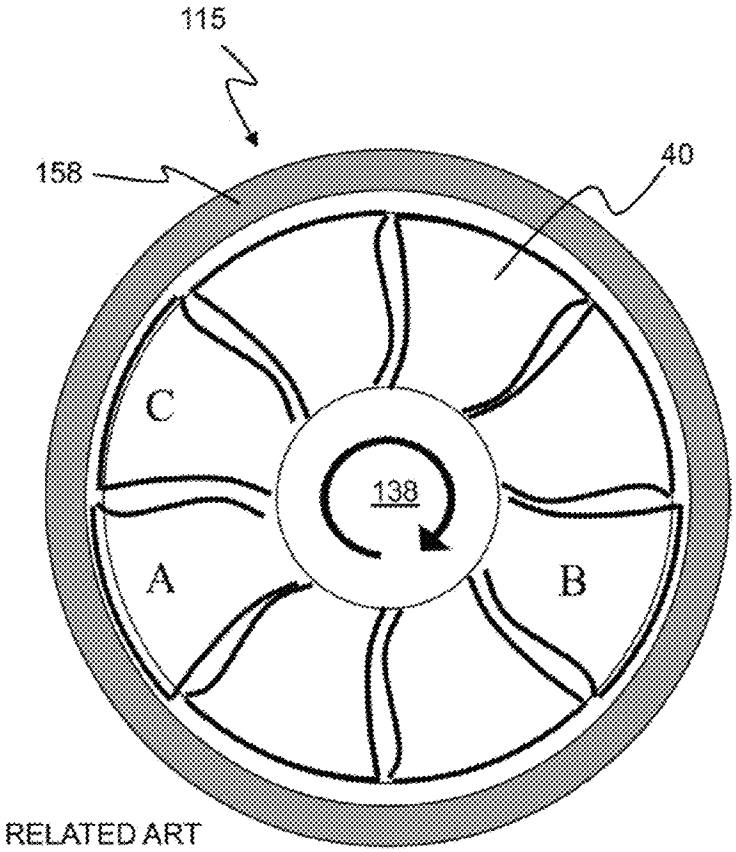
FIGS. 5A to 5E illustrate a fan assembly of related art at different stages during engine pass-off.

Referring to FIGS. 5A and 6A, a series of fan blades 40 (only one labelled for clarity) are mounted to a hub 138, 338. The fan blades 40 are of differing lengths, and it can be seen that the fan blades labelled with an A, B and C are longer than the other fan blades. FIGS. 5A and 6A show the fan assemblies 115, 315 before the fan has started to rotate, e.g. a fan assembly straight from an assembly or manufacturing line.

Figure 6B:
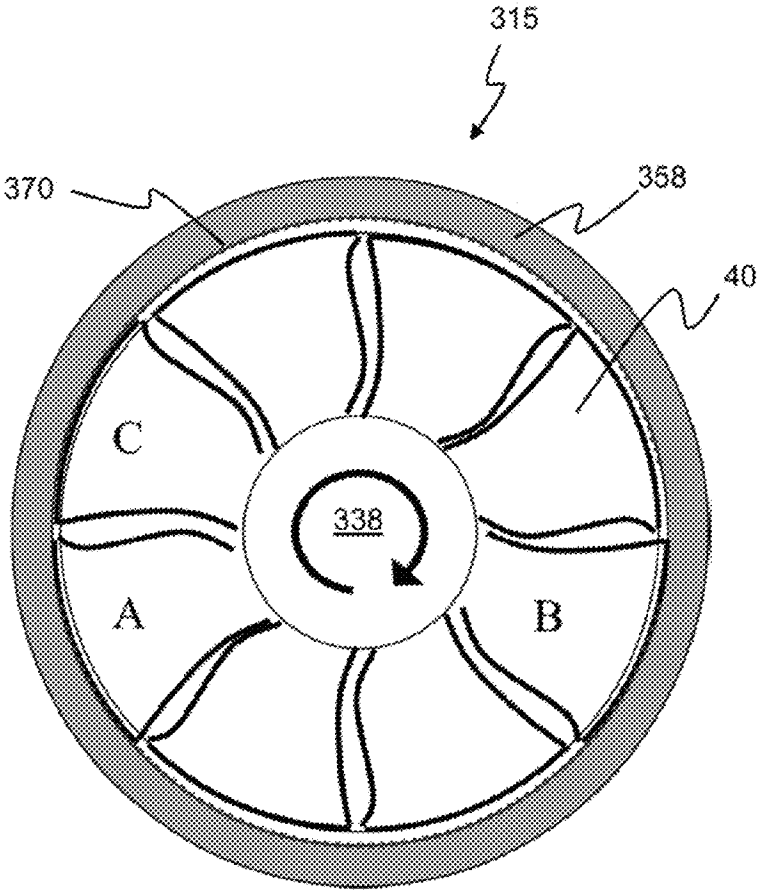
Figure 5B:
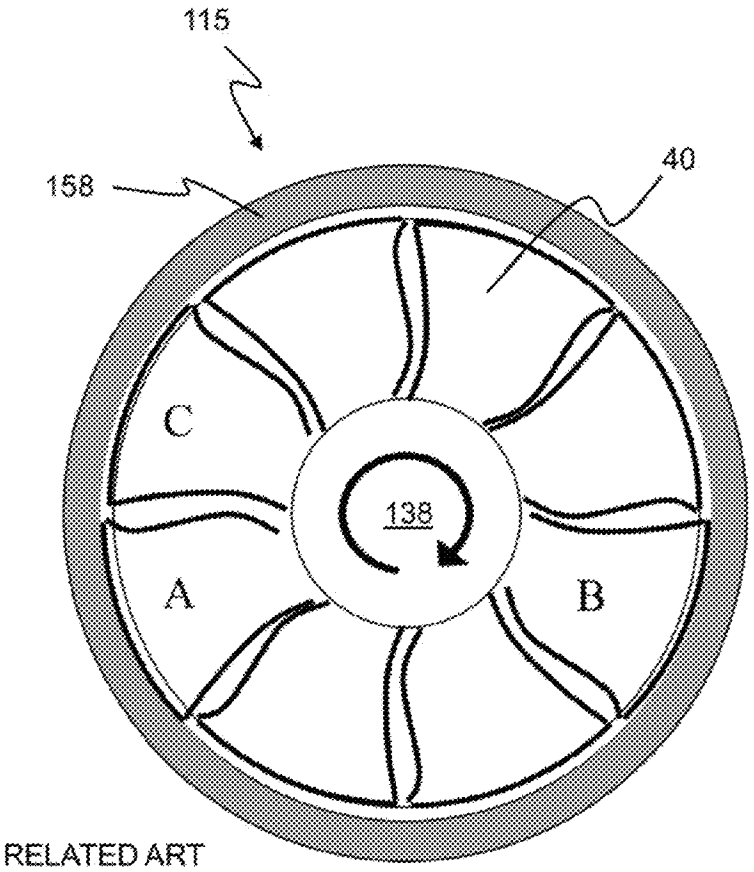
RELATED ART Fig. 5B

FIGS. 5B and 6B show the related art fan assembly 115 and the fan assembly 315 of the present embodiment, respectively, during a low speed rotation of the fan blades 40. It can be seen from FIG. 5B that the fan blades labelled A, B and C the fan assembly 115 of related art are abrading away the abradable layer 158 of the fan case. However, the fan blades A, B and C the fan assembly 315 of the presently described embodiment are being abraded by the abrasive layer 370 of the fan case. This means that the gap between the shorter fan blades 40 and the fan track liner is smaller for the fan assembly 315 of the present embodiment than the fan assembly 115 of related art.

Figure 6C:
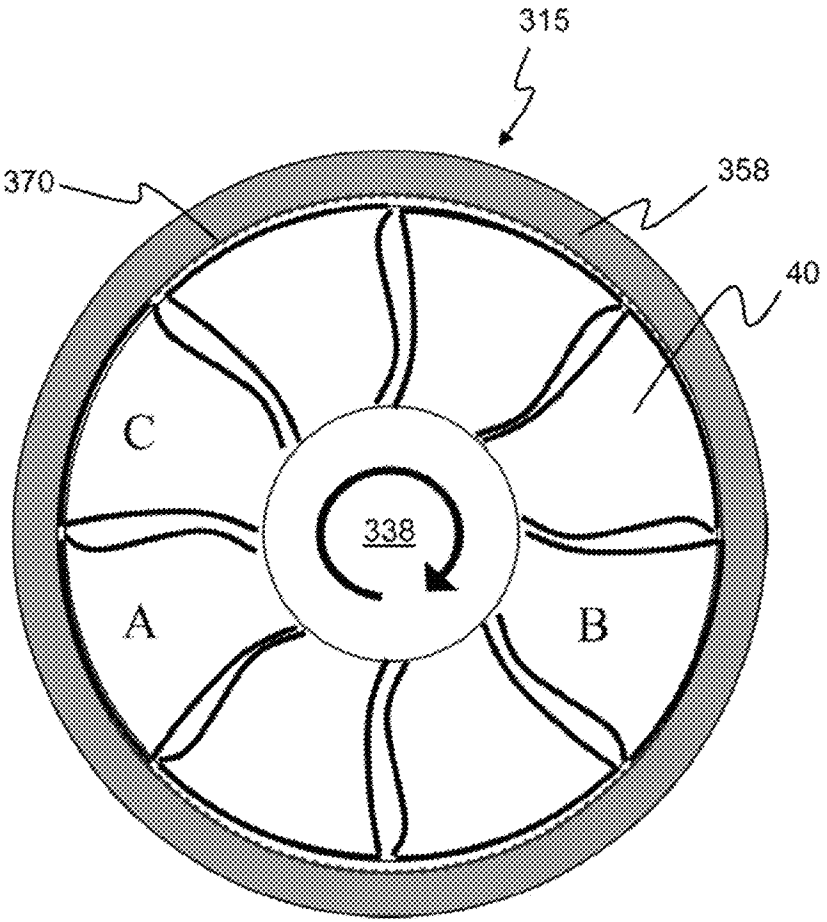
Figure 5C:
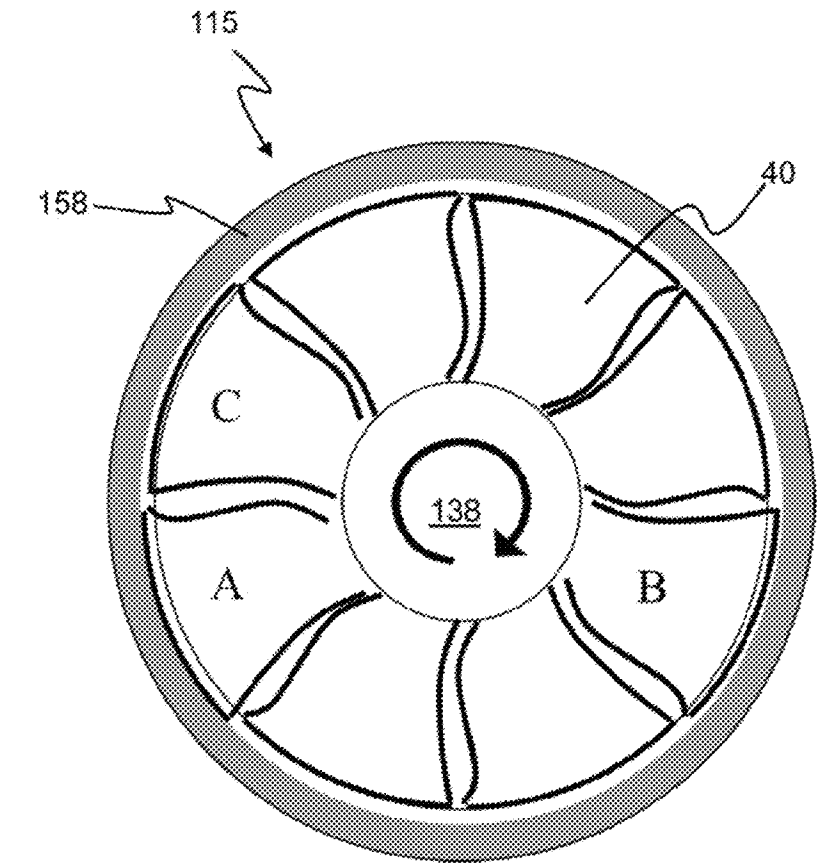
Fig. 5C RELATED ART

Referring now to FIGS. 5C and 6C, the fan assemblies 115, 315 when the fan is rotating at a higher rotational speed are shown. It can be seen that the blades A and B are longer than the blade C. Referring to FIG. 5C the blades A and B are abrading the abradable liner 158 of a related art fan case so that there is an increased gap between the shorter blades and the longer blade C. However, referring to FIG. 6C it can be seen that there remains a close gap between all the blades 40 of the fan of the fan assembly 315 of the presently described embodiment because the abrasive layer 370 of the fan track liner is abrading the tips of the longer blades.

Figure 6D:
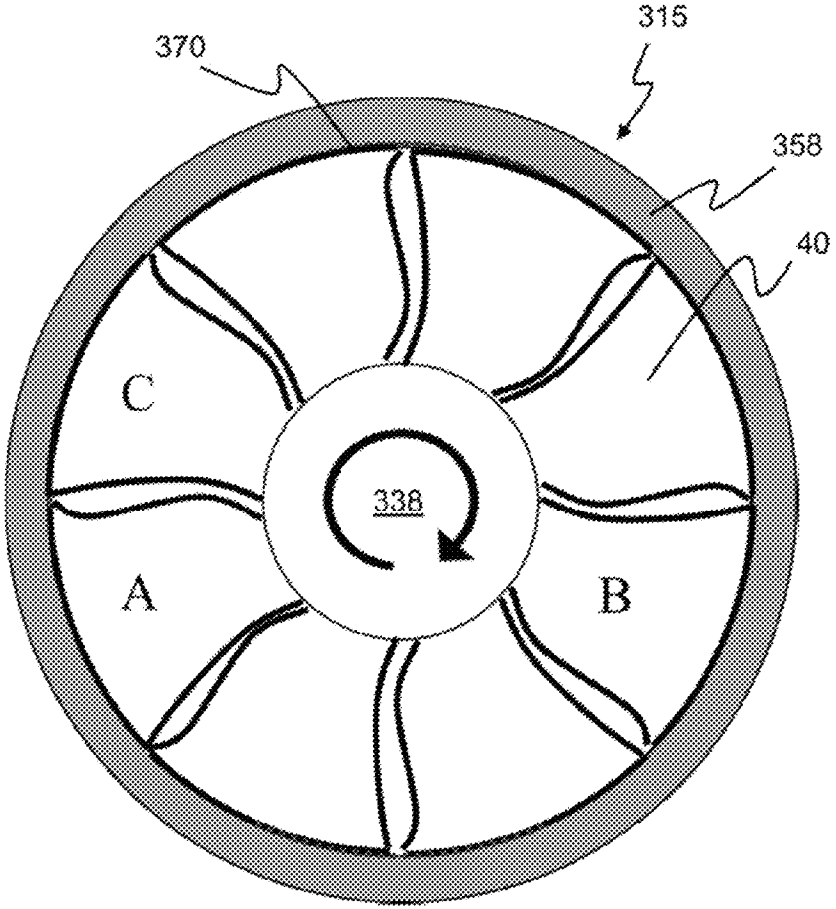
Figure 5D:
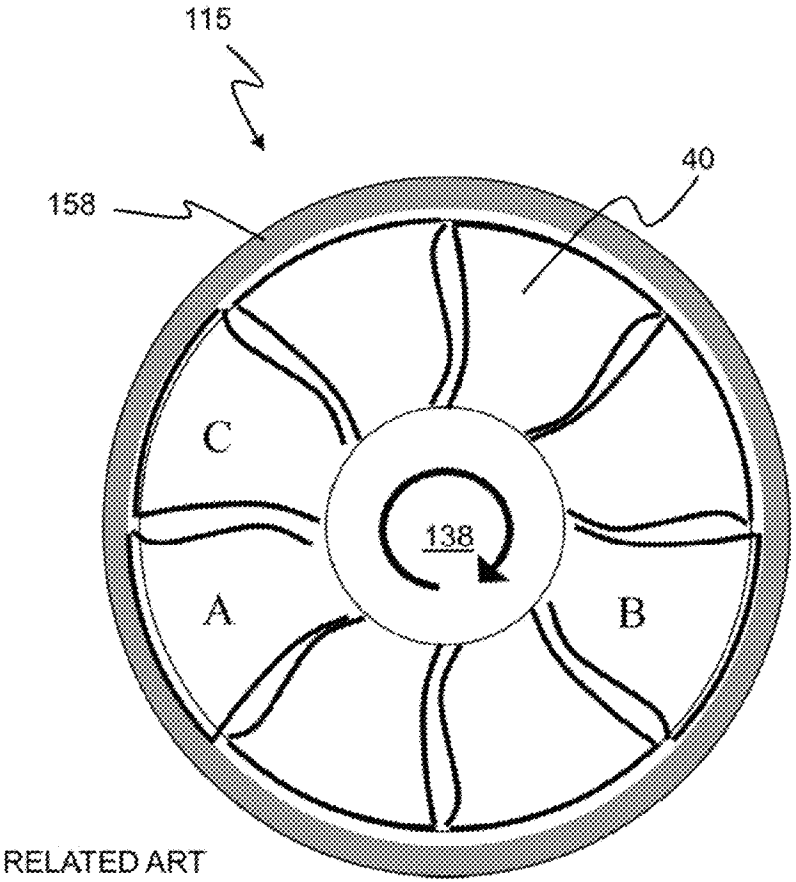
RELATED ART Fig. 5D

FIGS. 5D and 6D illustrate the fan assemblies 115, 315 when the fan is rotating at maximum speed. Referring to FIG. 5D, it can be seen that the fan blade labelled A in the fan assembly 115 of related art is the only blade in close contact with the fan track liner, and there is a gap between all other blades and the fan track liner. The size of the gap varies depending on the original length of the fan blade 40. However, referring to FIG. 6D it can be seen that all of the blades 40 of the fan assembly 315 of the presently described embodiment are running with a minimal clearance to the fan track liner. This minimal clearance reduces over tip leakage and therefore improves the efficiency of the engine.

Figure 6E:
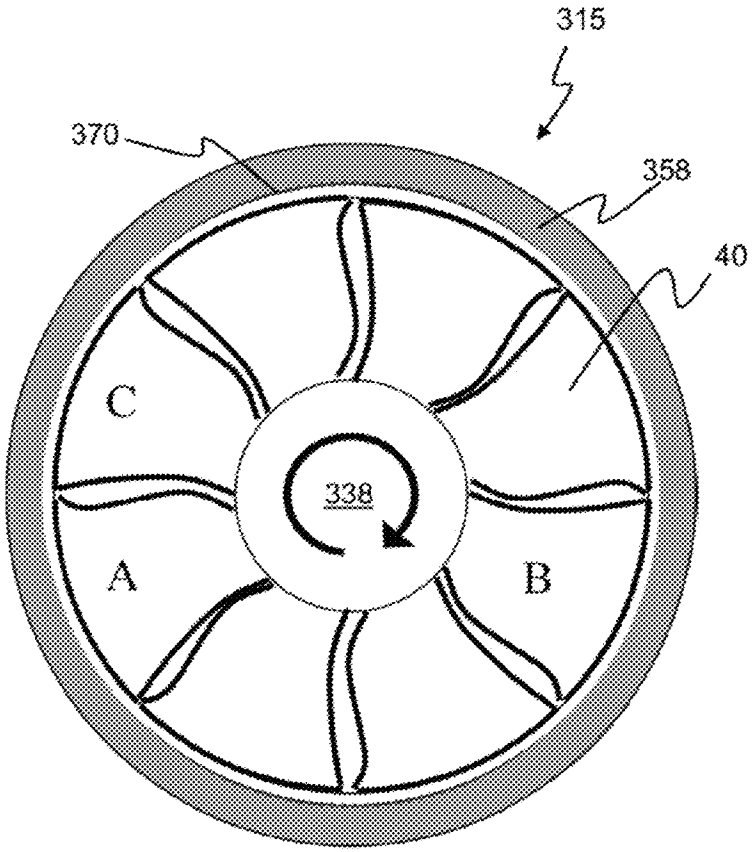
Figure 5E:
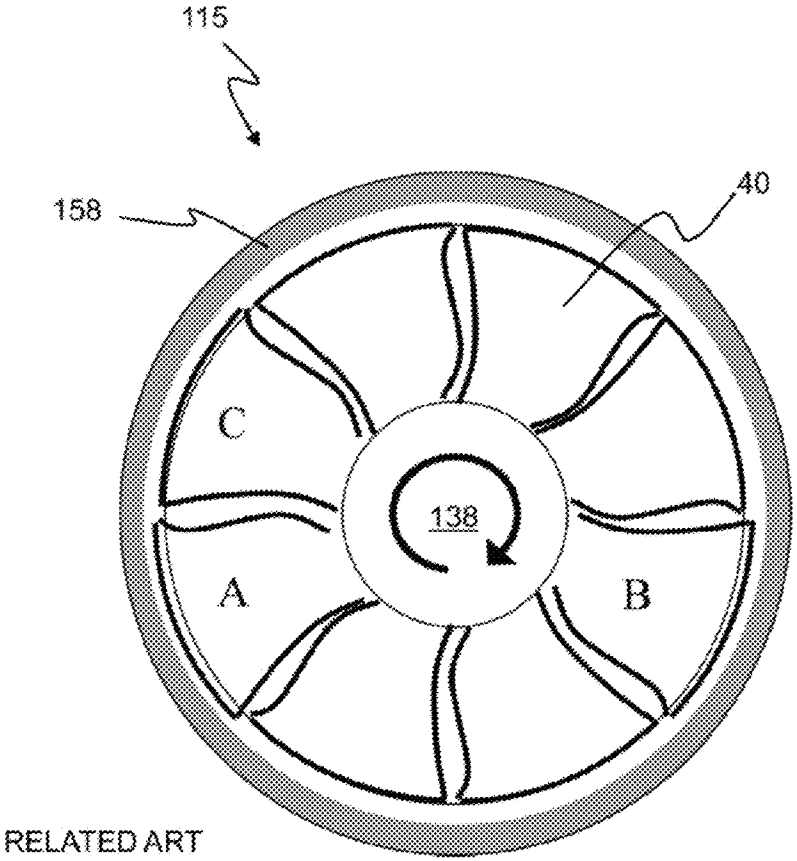
RELATED ART Fig. 5E

When in service on-wing of an aircraft, generally a maximum rotational speed will occur during take-off. Once the plane is cruising, the engine speed will decrease. Referring to FIGS. 5E and 6E the casing assemblies 115, 315 at an engine speed that can be considered to be a cruising speed are shown. At cruising speed the length of the fan blades 40 is shorter than the length of the fan blades at a high speed (e.g. during take-off), due to lower centrifugal forces. In the fan assembly 115 of related art (shown in FIG. 5E), this means that there is a large gap between all the blades except for the longest blade A. However, in the fan assembly 315 of the presently described embodiment, the fan blades 40 are all substantially the same length, which means that the clearance gap between the fan blades 40 and abradable layer 358 is consistent circumferentially around the fan case. It can also be seen that although there is a gap because of the shorter effective length of the blades at a reduced running speed, the gap between the blades and the fan track liner is significantly smaller than the gap between the shorter blades and the fan track liner of the fan assembly 115 of related art.

It can also be seen that after a first run to maximum speed, there is only a small amount of abrasive remaining in only a small section of the fan track liner (the abrasive remaining because the casing is slightly out-of-round due to manufacturing tolerances). This advantageously means that if during operation of the engine there are aero loads, e.g. turbulence, that cause the blades to move or the fan case to flex, the abradable liner rather than the fan blade will abrade in the affected area. This means that only the tip leakage in a particular area of the casing is affected rather the tip leakage being affected around the entire circumference of the liner, which would occur if the abrasive remained in place during operation of the engine.

The engine will be run for the first time to during engine pass-off (or engine run-in) testing that is performed on all engines before they are positioned on-wing of an aircraft. The thickness of the abrasive layer 370 will be selected so that a large proportion or all of the abrasive layer will be removed from the fan track liner before the engine is positioned on-wing. The thickness of the abrasive layer is also selected so that the blades of the engine will all be of a similar length when the engine is mounted on-wing.

Once an engine has been run during the engine pass-off (e.g. at maximum speed) the resulting engine will have fan blade lengths within the region of ±0.15 mm or better.

As described above, the fan assembly 315 of the present embodiment will have improved blade tip clearance which will result in improved fan efficiency at all operating conditions.

The described fan assembly 315 may also reduce the amount of tip blueing. Tip blueing is a term understood in the art and occurs in fan assemblies of the prior art where there are large aero loadings on the fan blades. The large aero loadings result in the longest fan blade aggressively rubbing the fan track liner. This can cause damage to the longest fan blade, i.e. tip blueing.

It will be appreciated by one skilled in the art that, where technical features have been described in association with one embodiment, this does not preclude the combination or replacement with features from other embodiments where this is appropriate. Furthermore, equivalent modifications and variations will be apparent to those skilled in the art from this disclosure. Accordingly, the exemplary embodiments of the invention set forth above are considered to be illustrative and not limiting.

The fan track liner has been described as being bonded to the annular casing element. However, in alternative embodiments the annular casing element may be releasably connected to the annular casing element, for example using a series of fasteners such as bolts. In further alternative embodiments the fan track liner may have a trap door arrangement.

Substantially the full length of the fan track liner has been described as being bonded to the casing element. However, in alternative embodiments only part of the fan track liner will be bonded to the casing element.

The fan case has been described as including hook, but in alternative embodiments a hook may not be provided. For example, instead an alternative fan containment system may be used. When the blades are composite blades, the fan blades may be configured to substantially break up on impact.

The described fan casing has been described for use with metallic fan blades, but the fan casing can also be used with composite fan blades. In exemplary alternative embodiments, the composite fan blades may comprise a metallic tip and/or a metallic leading edge.

The use of a sacrificial abrasive layer has been described for use on a fan case. However, the person skilled in the art will appreciate that the described sacrificial abrasive layer can be applied to any rotor or stationary member in an engine e.g. between a compressor drum and stator, a compressor blade and casing, a turbine blade and casing and/or an arm or flange of a turbine disc and stator. For example, the abradable layer may form part of or define a seal between the rotating and stationary members. Alternatively, the use of a sacrificial abrasive layer may be used on any rotating machine where minimum clearance is achieved with rubbing and where neither the rotating part nor the stationary member can be guaranteed to be round and concentric with each other.

In the described embodiment, the abrasive layer is provided by diamond grit suspended in a resin matrix; the grit and matrix mixture being applied evenly around the casing with a uniform depth and width. However, in alternative embodiments the abrasive layer may have a different geometrical arrangement as well as compositional arrangement. For example, the abrasive layer may have a tapered depth, a varying width, regular repeating pattern, a random pattern, discrete lines, curved lines, wavy lines, zig-zag lines, varying density, and/or various shapes (e.g. circles, squares, triangles).

The invention claimed is:

1. A method of manufacturing a gas turbine engine, the method comprising:

providing a series of fan blades about a hub, arranging an annular fan casing having an annular fan track liner circumferentially around the fan blades, wherein the fan track liner comprises an abradable layer and an abrasive layer on a radially inner surface of the abradable layer; and rotating the fan blades such that the abrasive layer removes a section from a tip of one or more of the fan blades, wherein the abrasive layer is substantially removed during rotation of the fan blades, and wherein the abrasive layer comprises abrasive particles.

2. The method according to claim 1, wherein the length of the one or more fan blades is reduced before the engine is mounted on-wing of an aircraft.

3. The method according to claim 1, wherein the abrasive layer is arranged so as to be substantially removed after engine pass-off and/or after running the engine at maximum speed for a predetermined number of rotation.

4. The method according to claim 1, wherein the abrasive layer comprises a resin matrix in which the abrasive particles are suspended.

5. The method according to claim 1, wherein the abrasive particles are sharp edged rhomboid particles.

6. The method according to claim 5, wherein the abrasive particles are diamond grit.

7. A method of trueing blades of a gas turbine engine, the gas turbine engine comprising an array of blades arranged around a hub and a casing member positioned circumferentially around the blades, the casing member having an abradable layer, the method comprising:

providing an arrangement for interacting with the fan blades to adjust the length of the fan blades during initial running of the engine;

running the engine for a pre-determined time so that the arrangement interacts with one or more of the fan blades and adjusts the length thereof, wherein the arrangement is substantially removed during rotation of the fan blades; and providing an abrasive layer on a radially inward surface of the casing member and running the engine so as to abrade one or more of the blades and shorten the length thereof, wherein the abrasive layer comprises abrasive particles.

8. A fan casing for fitment around an array of radially extending fan blades of a gas turbine engine, the fan casing comprising:

an annular casing element; and an annular fan track liner positioned radially inward of the annular casing element, wherein the fan track liner comprises an abradable layer and an abrasive layer, the abrasive layer being positioned radially inward of the abradable layer and proximal, in use, to the fan blades, wherein the abrasive layer is a sacrificial abrasive layer, wherein the abrasive layer is arranged so as to be substantially removed after engine pass-off and/or after running the engine at maximum speed for a predetermined number of rotation, and wherein the abrasive layer comprises abrasive particles.

9. The fan casing according to claim 8, wherein the abrasive layer comprises a resin matrix in which the abrasive particles are suspended.

10. The fan casing according to claim 8, wherein the abrasive particles are sharp edged rhomboid particles.

11. The fan casing according to claim 10, wherein the abrasive particles are diamond grit.

* * * * *